US009262998B2

(12) United States Patent
Chiang

(10) Patent No.: US 9,262,998 B2
(45) Date of Patent: Feb. 16, 2016

(54) DISPLAY SYSTEM AND DATA TRANSMISSION METHOD THEREOF

(71) Applicant: HIMAX TECHNOLOGIES LIMITED, Tainan (TW)

(72) Inventor: Chi-Cheng Chiang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 322 days.

(21) Appl. No.: 13/927,915

(22) Filed: Jun. 26, 2013

(65) Prior Publication Data

US 2015/0002525 A1 Jan. 1, 2015

(51) Int. Cl.
*G09G 5/18* (2006.01)
*G09G 5/12* (2006.01)

(52) U.S. Cl.
CPC .. *G09G 5/18* (2013.01); *G09G 5/12* (2013.01); *G09G 2320/103* (2013.01); *G09G 2360/18* (2013.01); *G09G 2370/04* (2013.01)

(58) Field of Classification Search
CPC ..... G09G 5/18; G09G 5/12; G09G 2320/103; G09G 2360/18; G09G 2370/04; G06T 1/60; G06T 1/00
See application file for complete search history.

(56) References Cited

U.S. PATENT DOCUMENTS

| | | | | |
|---|---|---|---|---|
| 2009/0284451 | A1 | 11/2009 | Yamamoto et al. | |
| 2011/0157198 | A1* | 6/2011 | Vasquez et al. | 345/531 |
| 2011/0169727 | A1* | 7/2011 | Akitt | 345/156 |
| 2012/0206461 | A1* | 8/2012 | Wyatt et al. | 345/501 |

FOREIGN PATENT DOCUMENTS

| | | |
|---|---|---|
| TW | 200939182 | 9/2009 |
| TW | 201110102 | 3/2011 |
| TW | 201133224 | 10/2011 |

OTHER PUBLICATIONS

"Office Action of Taiwan Counterpart Application," issued on May 13, 2015, p. 1-p. 6, in which the listed references were cited.

* cited by examiner

*Primary Examiner* — Xiao Wu
*Assistant Examiner* — Chong Wu
(74) *Attorney, Agent, or Firm* — J.C. Patents

(57) ABSTRACT

A display system and a data transmission method thereof are provided. When a first frame stored in a frame buffer and a plurality of second frames to be outputted by an audio and video (AV) source are the same, the AV source set a AV control signal corresponding to a self-refresh mode, and a timing controller controlled by the AV control signal accesses the first frame to output a display data. When the first frame and the second frames are different from each other, the AV source sets the AV control signal corresponding to a normal mode, and sets a AV data signal according to the second frames, and the timing controller controlled by the AV control signal outputs the display data corresponding to the received second frame or accesses the frame buffer to output the display data according to timings of the AV data signal and the display data.

32 Claims, 8 Drawing Sheets

DISPLAY SYSTEM AND DATA TRANSMISSION METHOD THEREOF

TECHNICAL FIELD

The invention relates to a display system and a data transmission method thereof, and more particularly, to a display system and a data transmission method thereof with a frame buffer.

BACKGROUND

Generally, a display apparatus may display a corresponding image according to a frames provided by an audio and video (AV) source. However, under the circumstance of displaying static images, the display apparatus may still receive the frames transmitted from the audio and video source continuously, and display the same image. In order to reduce the power consumption when the display apparatus receives the frames to display the static images, a frame buffer for storing an entire frame may be disposed in the display apparatus. Thus, under the circumstance of displaying dynamic images, the display apparatus may display a corresponding image according to a frame provided by the audio and video source, and under the circumstance of displaying static images, the display apparatus may store the static frame in the frame buffer, and the display apparatus displays according to the static frame stored in the frame buffer.

Nevertheless, when the audio and video source provides the dynamic frame again, it is possible that the operation timing of the display apparatus may not synchronize with the operation timing of the frame provided by the audio and video source, and therefore, the image displayed by a display panel may be affected when the display apparatus directly provides the dynamic frame to a driving circuit of the display panel. Thus, providing new dynamic frames to the driving circuit of the display panel without affecting the operation of the display panel has become one of the design concerns for this type of display apparatus.

SUMMARY

Accordingly, the invention is directed to a display system and a data transmission method thereof, capable of preventing a display apparatus being displayed abnormal when the display apparatus is switched from a self-refresh mode to a normal mode.

The invention provides a display system including an audio and video source and a display apparatus. The audio and video source provides an audio and video control signal and an audio and video data signal. The display apparatus includes a frame buffer, a timing controller, a display panel and a driving circuit. The timing controller is coupled to the frame buffer and the audio and video source to receive the audio and video control signal and the audio and video data signal, and to output a display data. The driving circuit is coupled to the timing controller and the display panel to drive the display panel according to the display data. When a first frame stored in the frame buffer and a plurality of second frames to be outputted by the audio and video source are the same, the audio and video source sets the audio and video control signal corresponding to a self-refresh mode, and the timing controller controlled by the audio and video control signal accesses the first frame stored in the frame buffer to output the display data. When the first frame stored in the frame buffer and the plurality of second frames to be outputted by the audio and video source are different from each other, the audio and video source sets the audio and video control signal corresponding to a normal mode, and sequentially sets the audio and video data signal according to the plurality of second frames, and the timing controller controlled by the audio and video control signal outputs the display data corresponding to the received second frame or accesses the frame buffer to output the display data, according to timings of the audio and video data signal and the display data.

The invention also provides a data transmission method of a display system including the following the steps. When a first frame stored in a frame buffer and a plurality of second frames to be outputted by an audio and video source are the same, an audio and video control signal corresponding to a self-refresh mode is set through the audio and video source, and the first frame stored in the frame buffer is accessed to output a display data through a timing controller controlled by the audio and video control signal in a display apparatus. When the first frame stored in the frame buffer and the plurality of second frames to be outputted by the audio and video source are different from each other, the audio and video control signal corresponding to a normal mode is set through the audio and video source, and an audio and video data signal is sequentially set according to the plurality of second frames, and the display data corresponding to the received second frame is outputted or the frame buffer is accessed to output the display data through the timing controller controlled by the audio and video control signal, according to timings of the display data and the audio and video data signal.

In an embodiment of the invention, when a starting time of a frame display period corresponding to the audio and video data signal is located within a first period of a frame period corresponding to the display data, the timing controller directly outputs the display data corresponding to the received second frame.

In an embodiment of the invention, the first period is located between a frame display period and a minimum tolerance vertical blank period of the corresponding frame period.

In an embodiment of the invention, when the starting time of the frame display period corresponding to the audio and video data signal is located within a second period and a third period of the frame period corresponding to the display data, the timing controller accesses the frame buffer to output the display data, wherein the first period, the second period and the third period are different from each other.

In an embodiment of the invention, when the starting time of the frame display period corresponding to the audio and video data signal is located within the second period of the frame period corresponding to the display data, the timing controller extends a plurality of frame periods corresponding to the display data.

In an embodiment of the invention, the timing controller extends a vertical blank period of each of the frame periods corresponding to the display data.

In an embodiment of the invention, the timing controller extends a plurality of horizontal blank periods of each of the frame periods corresponding to the display data.

In an embodiment of the invention, when the starting time of the frame display period corresponding to the audio and video data signal is located within the third period of the frame period corresponding to the display data, the timing controller shortens a plurality of frame periods corresponding to the display data.

In an embodiment of the invention, the timing controller shortens a vertical blank period of each of the frame periods corresponding to the display data.

In an embodiment of the invention, the timing controller shortens a plurality of horizontal blank periods of each of the frame periods corresponding to the display data.

In an embodiment of the invention, when a starting time of a frame display period corresponding to the display data is located in a vertical blank period of a frame period corresponding to the audio and video data signal, the timing controller directly outputs the display data corresponding to the received second frame.

In an embodiment of the invention, when a reading-writing ability of the frame buffer is greater than or equal to a total of a bit rate of the display data and a bit rate of the audio and video data signal, the timing controller writes the received second frame into the frame buffer, and the timing controller accesses the second frame stored in the frame buffer to output the display data.

In an embodiment of the invention, when the reading-writing ability of the frame buffer is less than the total of the bit rate of the display data and the bit rate of the audio and video data signal, the timing controller neglects the received second frame, and the timing controller accesses the first frame stored in the frame buffer to output the display data.

In an embodiment of the invention, the second period is located within a frame display period of the corresponding frame period and is adjacent to the first period, wherein a time length of the second period equals to a threshold time of the frame display period, and the third period is adjacent to the second period corresponding to the same frame period and the first period corresponding to a next frame period.

In an embodiment of the invention, when the starting time of the first frame display period corresponding to the audio and video data signal is located within the minimum tolerance vertical blank period or a frame display period of the frame period corresponding to the display data, the timing controller accesses the frame buffer to output the display data and shortens a plurality of frame periods corresponding to the display data.

In an embodiment of the invention, the timing controller increases the bit rate of the display data.

In an embodiment of the invention, the timing controller including a data receiver, a data multiplexer, a timing generator and a frame controller. The data receiver is coupled to the audio and video source to receive the audio and video data signal, and outputs a frame information corresponding to the audio and video data signal, a first clock signal corresponding to the audio and video data signal and the display data corresponding to the audio and video data signal. The data multiplexer has a first input terminal, a second input terminal and a first output terminal, wherein the first input terminal is coupled to the data receiver to receive the display data corresponding to the audio and video data signal. The data multiplexer couples the first output terminal to the first input terminal or the second output terminal according to a state control signal. The timing generator is coupled to the data receiver to receive the frame information corresponding to the audio and video data signal, coupled to the audio and video source to receive the audio and video control signal, and having a clock modulator, wherein the timing generator outputs a access control signal according to the frame information and outputs the state control signal according to the audio and video control signal, and the clock modulator provides a second clock signal and regulates the second clock signal according the frame information corresponding to the audio and video data signal. The frame controller is coupled to the data receiver, the frame buffer, the timing generator and the second input terminal of the data multiplexer, determining whether to access the frame buffer according to the access control signal, receives the display data corresponding to the audio and video data signal according to first clock signal, and accesses the frame buffer according to the second clock signal.

In an embodiment of the invention, the timing controller shortens a vertical blank period of each of the frame periods corresponding to the display data.

In an embodiment of the invention, the timing controller shortens a plurality of horizontal blank periods of each of the frame periods corresponding to the display data.

In an embodiment of the invention, when the starting time of the first frame display period corresponding to the audio and video data signal is located within the frame display period of the frame period corresponding to the display data, the timing controller calculates a first difference of the starting time of the frame display period corresponding to the audio and video data signal and an end time of the frame display period of the frame period corresponding to the display data which is closed to and after the starting time, and regulates the frame period corresponding to the display data according to the following equation:

$$\text{Frame_Period}_{clk_o_new} \times N + \text{Offset}_{clk_o_ori} = \text{Frame_Period}_{clk_i} \times N - V_\text{Blanking}_{min}$$

wherein, $\text{Frame_Period}_{clk_o_new}$ is the shortened frame period corresponding to the display data, N is a positive integer and greater than or equal to 1, $\text{Offset}_{clk_o_ori}$ is the first difference, $\text{Frame_Period}_{clk_i}$ is the frame period corresponding to the audio and video data signal, and $V_\text{Blanking}_{min}$ is a period of a vertical blank period corresponding to the audio and video data signal subtracting from a minimum tolerance vertical blank period corresponding to the audio and video data signal.

In an embodiment of the invention, when the starting time of the first frame display period corresponding to the audio and video data signal is located within the minimum tolerance vertical blank period of the frame period corresponding to the display data which is closed to and after the starting time, the timing controller calculates a second difference of the starting time of the frame display period corresponding to the audio and video data signal and an end time of the frame display period of a previous frame period corresponding to the display data, and regulates the frame period corresponding to the display data according to the following equation:

$$\text{Frame_Period}_{clk_o_new} \times N + \text{Offset}_{clk_o_ori} \times \text{Frame_Period}_{clk_o_new} / \text{Frame_Period}_{clk_o_ori} = \text{Frame_Period}_{clk_i} \times N - V_\text{Blanking}_{min}$$

wherein, $\text{Frame_Period}_{clk_o_new}$ is the shortened frame period corresponding to the display data, N is a positive integer and greater than or equal to 1, $\text{Offset}_{clk_o_ori}$ is the first difference, $\text{Frame_Period}_{clk_o_ori}$ is the original frame period corresponding to the display data, $\text{Frame_Period}_{clk_i}$ is the frame period corresponding to the audio and video data signal, and $V_\text{Blanking}_{min}$ is a period of a vertical blank period corresponding to the audio and video data signal subtracting from a minimum tolerance vertical blank period corresponding to the audio and video data signal.

According to the foregoing, the display system and the data transmission method thereof are provided in the embodiments of the invention. When the display apparatus is operated under the normal mode, the timing controller is controlled by the audio and video control signal, and outputs the display data corresponding to the received second frame or accesses the frame buffer to output the display data, so as to prevent the display apparatus being displayed abnormal, according to the timings of the display data and the audio and video data signal.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
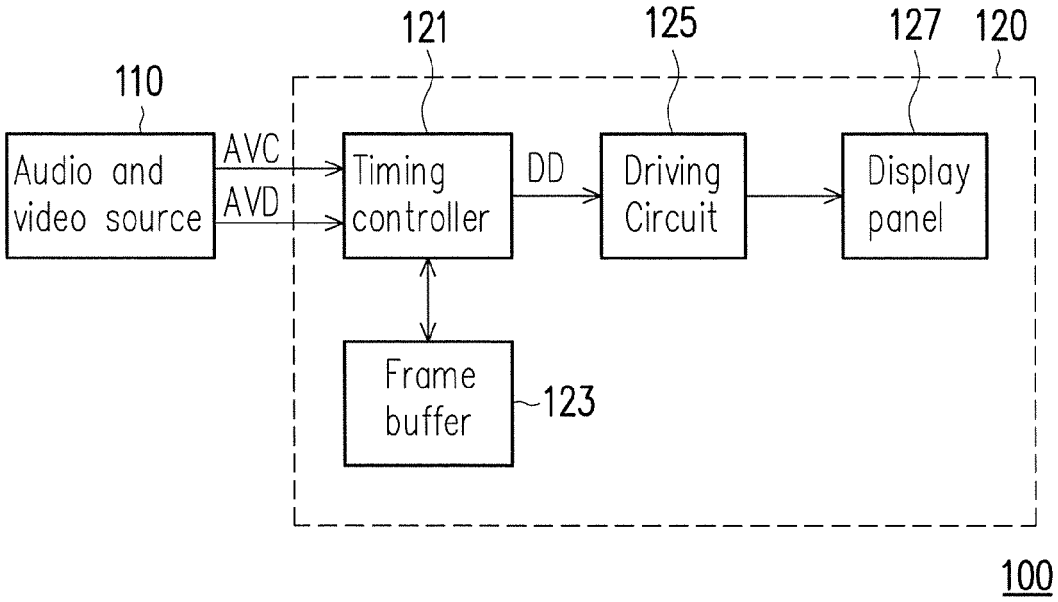
FIG. 1 is a schematic system diagram of a display system according to an embodiment of the invention.

FIG. 1 is a schematic system diagram of a display system according to an embodiment of the invention. Referring to FIG. 1, in the embodiment, the display system 100 includes an audio and video (AV) source 110 and a display apparatus 120, wherein the audio and video source 110 may be an audio and video player or a computer. The display apparatus 120 includes a timing controller 121, a frame buffer 123, a driving circuit 125 and a display panel 127.

The audio and video source 110 provides an audio and video control signal AVC and an audio and video data signal AVD. The timing controller 121 is coupled to the frame buffer 123 and the audio and video source 110, so as to receive the audio and video control signal AVC and the audio and video data signal AVD, and to output a display data DD. The driving circuit 125 is coupled to the timing controller 121 and the display panel 127, so as to drive the display panel 127 according to the display data DD.

In the embodiment, when the frames provided by the audio and video source 110 are dynamic frames (namely, a plurality of continuous frames transmitted by the audio and video data signal AVD are all different frames), the audio and video source 110 sets the audio and video control signal AVC corresponding to a normal mode. Here, the timing controller 121 controls the display apparatus 120 to be operated under the normal mode according to the audio and video control signal AVC, and the timing controller 121 outputs the display data DD according to the frame transmitted by the audio and video data signal AVD.

When the frames provided by the audio and video source 110 are static frames (namely, the frames transmitted by the audio and video data signal AVD are all the same frames), the audio and video source 110 sets the audio and video control signal AVC corresponding to a self-refresh mode. Here, the timing controller 121 controls the display apparatus 120 to be operated under the self-refresh mode according to the audio and video control signal AVC. Moreover, the timing controller 121 stores a first one (corresponding to the first frame) among the plurality of static frames in the frame buffer 123, and simultaneously outputs the display data DD corresponding to the first static frame.

Subsequently, when the plurality of continuous frames (corresponding to the second frames) to be outputted by the audio and video source 110 and the static frame stored in the frame buffer 123 are the same, the audio and video control signal AVC may always correspond to the self-refresh mode, in order for the timing controller 121 to access the static frame stored in the frame buffer 123 continuously to output the display data DD. Wherein, the audio and video source 110 may store the frame corresponding to the static frame in the frame buffer 123 so as to perform a comparison. The audio and video source 110 may not set the audio and video data signal AVD according to the frame to be outputted, namely, the audio and video data signal AVD is appeared to be in an idle state.

Alternatively, when the plurality of continuous frames (corresponding to the second frames) to be outputted by the audio and video source 110 and the static frame stored in the frame buffer 123 are different from each other (namely, the frames transmitted by the audio and video data signal AVD are all the dynamic frames), the audio and video source 110 sets the audio and video control signal AVC corresponding to the normal mode again. Here, the timing controller 121 controls the display apparatus 120 to be operated under the normal mode again according to the audio and video control signal AVC. Since the display apparatus 120 operated under the self-refresh mode may not synchronize with the audio and video source 110, it is possible that a timing of the audio and video data signal AVD may be different from a timing of the display data DD outputted by the timing controller 121.

According to the foregoing, when the display apparatus 120 operated under the self-refresh mode is switched to be operated under the normal mode, the timing controller 121 is controlled by the audio and video control signal AVC, and outputs the display data DD corresponding to the received dynamic frame or accesses the frame buffer 123 to output the display data DD, according to the timing of the display data DD and the timing of the audio and video data signal AVD. Moreover, when the timing controller 121 accesses the frame buffer 123 to output the display data DD, it is indicated that the timing controller 121 is not synchronized with the timing of the audio and video data signal AVD. Thus, the timing controller 121 may adjust the timing of the display data DD, so as to synchronize with the timing corresponding to the audio and video data signal AVD by adjusting the timing of the display data DD gradually.

Figure 2:
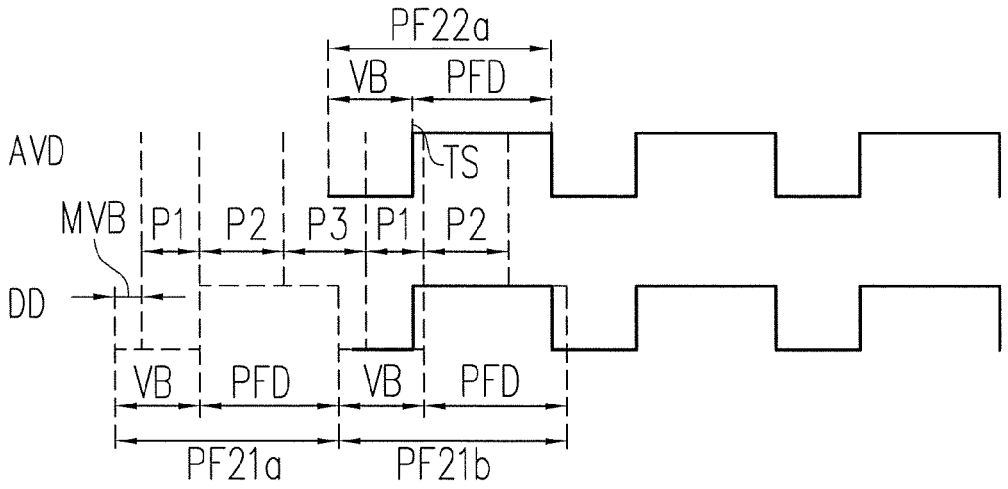
FIG. 2 is a schematic timing diagram of a display system transmitting data according to an embodiment of the invention.

FIG. 2 is a schematic timing diagram of a display system transmitting data according to an embodiment of the invention. Referring to FIG. 1 and FIG. 2, in the embodiment, when the display apparatus 120 operated under the self-refresh mode is switched to be operated under the normal mode, the timing controller 121 outputs the display data DD continuously, such that the timing of the display data DD may be formed a plurality of frame periods (such as PF21*a*, PF21*b*). Moreover, the audio and video data signal AVD may be set corresponding to the dynamic frame to be outputted by the audio and video source 110, such that the timing of the audio and video data signal AVD may be formed a plurality of frame periods (such as PF22*a*).

In the embedment, each of the frame periods (such as PF21*a*, PF21*b*, PF22*a*) includes a vertical blank period VB and a frame display period PFD. Moreover, each of the frame periods (such as PF21*a*, PF21*b*) corresponding to the display data DD may be divided into a first period P1, a second period P2 and a third period P3 without overlapping each other (namely, the first period P1, the second period P2 and the third period P3 are different from each other). The first period P1 is located between the frame display period PFD and a minimum tolerance vertical blank period MVB of the corresponding frame period (such as PF21*a*, PF21*b*). The second period P2 is located within the frame display period PFD of the corresponding frame period (such as PF21*a*, PF21*b*), and is adjacent to the first period P1, wherein a time length of the second period P2 equals to a threshold time Tth (which will be described in the following description) of the frame display period PFD, and the third period P3 is adjacent to the second period P2 corresponding to the same frame period (such as PF21*a*) and the first period P1 corresponding to a next frame period (such as PF21*b*).

In the embodiment, a starting time TS of the frame display period PFD in the frame period PF22*a* is located within the first period P1 of the frame period PF21*b*. Here, it is indicated that the driving circuit 125 is ready to receive the display data DD, (namely, the display data DD corresponding to the dynamic frame transmitted by the audio and video data signal AVD, is directly transmitted to the driving circuit 125, the driving circuit 125 may drive the display panel 127 according to the received display data DD). Therefore, the timing controller 121 may transmit the display data DD corresponding to the dynamic frame transmitted by the audio and video data signal AVD directly to the driving circuit 125. As shown in FIG. 2, the dash line indicating the original timing of the display data DD is replaced by the solid line indicating the timing of the audio and video data signal AVD.

Figure 3:
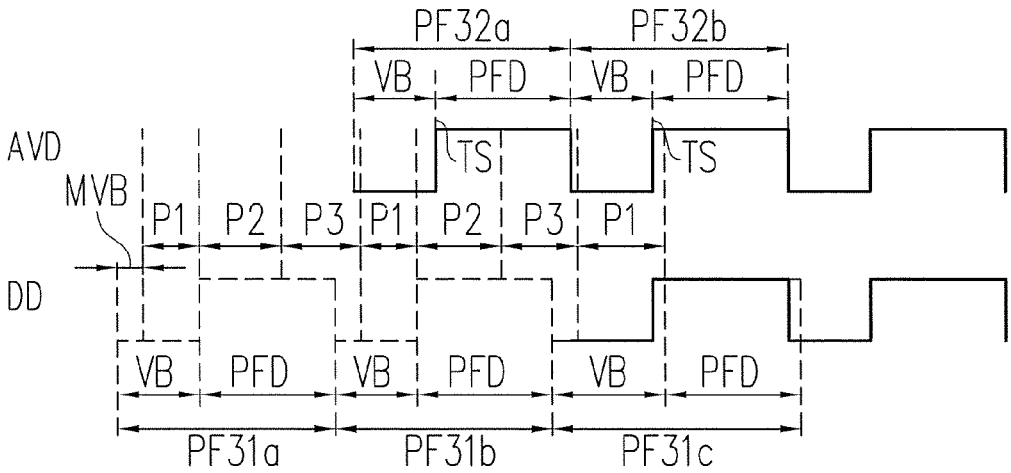
FIG. 3 is a schematic timing diagram of a display system transmitting data according to an embodiment of the invention.

FIG. 3 is a schematic timing diagram of a display system transmitting data according to an embodiment of the invention. Referring to FIG. 1 through FIG. 3, in the embodiment, the timing of the display data DD may also be formed a plurality of frame periods (such as PF31*a*~PF31*c*), and the timing of the audio and video data signal AVD may be formed a plurality of frame periods (such as PF32*a*, PF32*b*), wherein the same or like reference numbers are applied to refer to the same or like parts in the drawings and the description.

In the embodiment, the starting time TS of the frame display period PFD in the frame period PF32*a* is located within the second period P2 of the frame period PF31*b*. Here, the display data DD corresponding to the static frame stored in the frame buffer 123 has already been transmitted to the driving circuit 125, and thus the timing controller 121 may still access the static frame stored in the frame buffer 123 continuously to maintain the integrity of the display data DD, so as to prevent the display panel 127 displaying incorrect images. Moreover, the starting time TS of the frame display period PFD in the frame period PF32*a* is located within the second period P2 of the frame period PF31*b* (namely, not located within the first period P1), which is indicated that the extended frame periods (such as PF31*a*~PF31*c*) corresponding to the display data DD may quicken the starting time TS of the frame display period PFD in the frame period (such as PF32*a*, PF32*b*) corresponding to the audio and video data signal AVD to be located within the first period P1 of one of the frame periods (such as PF31*a*~PF31*c*) corresponding to the display data DD. Therefore, the timing controller 121 may extend the vertical blank period VB of the frame period PF31*c*.

Subsequently, after the vertical blank period VB of the frame period PF31*c* is extended, the starting time TS of the frame display period PFD in the frame period PF32*b* will be located within the first period P1 of the frame period PF31*c*. Therefore, the timing controller 121 may transmit the display data DD corresponding to the dynamic frame transmitted by the audio and video data signal AVD directly to the driving circuit 125. As shown in FIG. 3, the dash line indicating the original timing of the display data DD is replaced by the solid line indicating the timing of the audio and video data signal AVD.

In the frame period PF31*b*, if the reading-writing speed of the frame buffer 123 is greater than or equal to a total of a bit rate of the display data DD and a bit rate of the audio and video data signal AVD, the timing controller 121 may store the dynamic frame transmitted by the audio and video data signal AVD to the frame buffer 123, and access the previous frame in the frame buffer 123 to output the display data DD continuously. On the other hand, if the reading-writing speed of the frame buffer 123 is less than the total of the bit rate of the display data DD and the bit rate of the audio and video data signal AVD, the timing controller 121 may neglect the dynamic frame transmitted by the audio and video data signal AVD, and access the frame in the frame buffer 123 to output the display data DD continuously.

Figure 4:
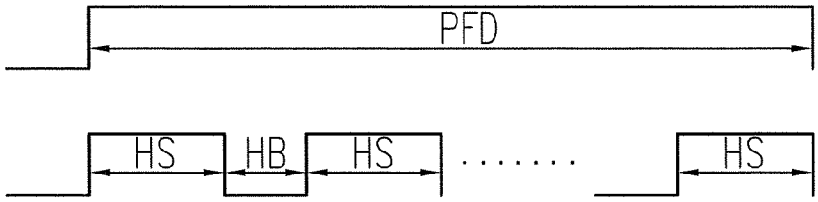
FIG. 4 is a schematic timing diagram of a single frame period according to an embodiment of the invention.

FIG. 4 is a schematic timing diagram of a single fame period according to an embodiment of the invention. Referring to FIG. 1 through FIG. 4, in the aforementioned embodiment, the starting time TS of the frame display period PFD in the frame period (such as PF32*a*, PF32*b*) corresponding to the audio and video data signal AVD may fall within the first period P1 of one of the frame periods (such as PF31*a*~PF31*c*) corresponding to the display data DD via the extended vertical blank period VB of the frame period (such as PF31*a*~PF31*c*) corresponding to the display data DD.

In the embodiment, the timing controller 121 may cause the starting time TS of the frame display period PFD in the frame period (such as PF32*a*, PF32*b*) corresponding to the audio and video data signal AVD to fall within the first period P1 of one of the frame periods (such as PF31*a*~PF31*c*) corresponding to the display data DD via the extended frame display period PFD of the frame period (such as PF31*a*~PF31*c*) corresponding to the display data DD. More specifically, the frame display period PFD corresponds to a plurality of horizontal scan periods HS and a plurality of horizontal blank periods HB, wherein the timing controller 121 may extend the plurality of horizontal blank periods HB so as to extend the frame display period PFD.

Figure 5:
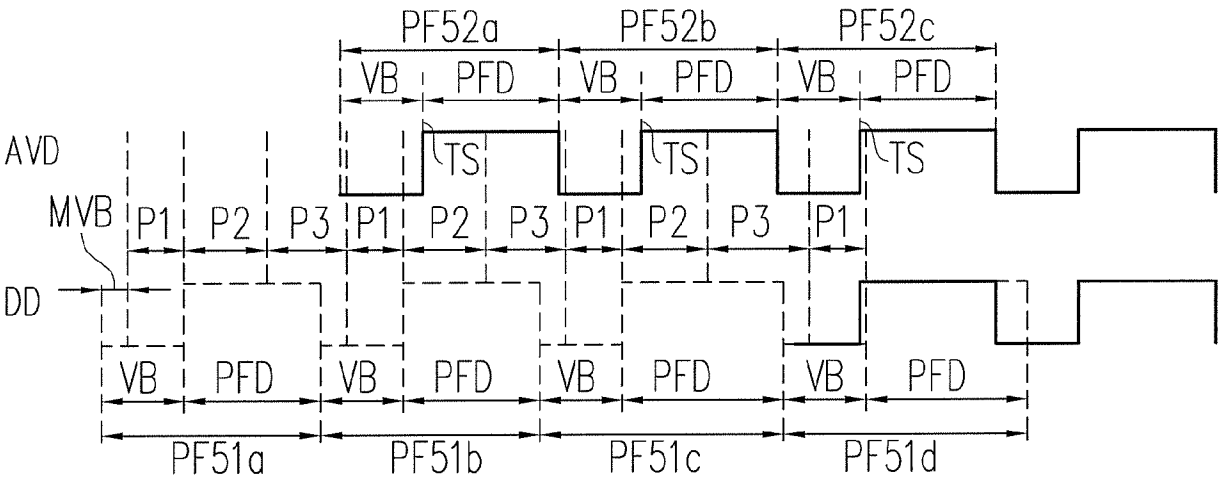
FIG. 5 is a schematic timing diagram of a display system transmitting data according to an embodiment of the invention.

FIG. 5 is a schematic timing diagram of a display system transmitting data according to an embodiment of the invention. Referring to FIG. 1 through FIG. 5, in the embodiment, the timing of the display data DD may also be formed a plurality of frame periods (such as PF51*a*~PF51*d*), and the timing of the audio and video data signal AVD may be formed a plurality of fame periods (such as PF52*a*~PF52*c*), wherein the same or like reference numbers are applied to refer to the same or like parts in the drawings and the description.

In the embedment, the starting time TS of the frame display period PFD in the frame period PF52*a* is located within the second period P2 of the frame period PF51*b* (namely, not located within the first period P1), and thus the timing controller 121 may still access the static frame stored in the frame buffer 123 continuously to output the display data DD, moreover, the timing controller 121 may extend the frame display periods PFD of the frame periods PF51*c* and PF51*d*. After the frame display period PFD of the frame period PF51*c* is extended, the starting time TS of the frame display period PFD in the frame period PF52*b* will be located within the second period P2 of the frame period PF51*c* (namely, not located within the first period P1), and thus the timing controller 121 may still access the static frame stored in the frame buffer 123 continuously to output the display data DD.

After the frame display period PFD of the frame period PF51*d* is extended, the starting time TS of the frame display period PFD in the frame period PF52*c* will be located within the first period P1 of the frame period PF51*d*. Therefore, the timing controller 121 may transmit the display data DD corresponding to the dynamic frame transmitted by the audio and video data signal AVD directly to the driving circuit 125. As shown in FIG. 5, the dash line indicating the original timing of the display data DD is replaced by the solid line indicating the timing of the audio and video data signal AVD.

In the frame periods PF51*b* and PF51*c*, if the reading-writing speed of the frame buffer 123 is greater than or equal to the total of the bit rate of the display data DD and the bit rate of the audio and video data signal AVD, the timing controller 121 may store the dynamic frame transmitted by the audio and video data signal AVD to the frame buffer 123, and access the previous frame in the frame buffer 123 to output the display data DD continuously. On the other hand, if the reading-writing speed of the frame buffer 123 is less than the total of the bit rate of the display data DD and the bit rate of the audio and video data signal AVD, the timing controller 121 may neglect the dynamic frame transmitted by the audio and video data signal AVD, and access the frame in the frame buffer 123 to output the display data DD continuously.

Figure 6:
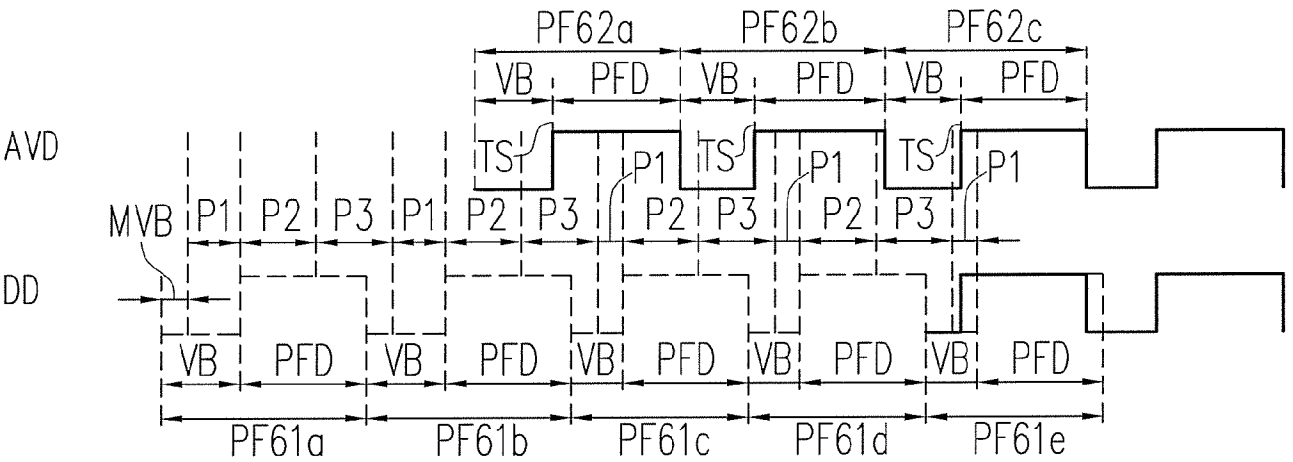
FIG. 6 is a schematic timing diagram of a display system transmitting data according to an embodiment of the invention.

FIG. 6 is a schematic timing diagram of a display system transmitting data according to an embodiment of the invention. Referring to FIG. 1, FIG. 2 and FIG. 6, in the embodiment, the timing of the display data DD may also be formed a plurality of frame periods (such as PF61*a*~PF61*e*), and the timing of the audio and video data signal AVD may be formed a plurality of frame periods (such as PF62*a*~PF62*c*), wherein the same or like reference numbers are applied to refer to the same or like parts in the drawings and the description.

In the embedment, the starting time TS of the frame display period PFD in the frame period PF62*a* is located within the third period P3 of the frame period PF61*b* (namely, not located within the first period P1). Here, the timing controller 121 may access the static frame stored in the frame buffer 123 continuously, moreover, the starting time TS of the frame display period PFD in the frame period PF62*a* is located within the third period P3 of the frame period PF61*b*, which is indicated that the shortened frame periods (such as PF61*a*~PF61*e*) corresponding to the display data DD may quicken the starting time TS of the frame display period PFD in the frame period (such as PF62*a*~PF62*c*) corresponding to the audio and video data signal AVD to be located within the first period P1 of one of the frame periods (such as PF61*a*~PF61*e*) corresponding to the display data DD. Therefore, the timing controller 121 may shorten the vertical blank periods VB of the frame periods PF61*c*~PF61*e*, and the shortened vertical blank periods VB are still greater than the minimum tolerance vertical blank period MVB.

After the vertical blank period VB of the frame period PF61*c* is shortened, the starting time TS of the frame display period PFD in the frame period PF62*b* will be located within the third period P3 of the frame period PF61*c* (namely, not located within the first period P1), and thus the timing controller 121 may still access the static frame stored in the frame buffer 123 continuously to output the display data DD. After the vertical blank period VB of the frame period PF61*d* is shortened, the starting time TS of the fame display period PFD in the frame period PF62*c* is not located within the frame period PF61*c* (namely, the starting time TS of the frame display period PFD in the frame period PF62*c* is not located within the first period P1 of the frame period PF61*c*), and thus the timing controller 121 may still access the static frame stored in the frame buffer 123 continuously to output the display data DD.

After the vertical blank period VB of the frame period PF61*e* is shortened, the starting time TS of the frame display period PFD in the frame period PF62*c* will be located within the first period P1 of the frame period PF61*e*. Therefore, the timing controller 121 may transmit the display data DD corresponding to the dynamic frame transmitted by the audio and video data signal AVD directly to the driving circuit 125. As shown in FIG. 6, the dash line indicating the original timing of the display data DD is replaced by the solid line indicating the timing of the audio and video data signal AVD.

In the frame periods PF61*b*~PF61*d*, if the reading-writing speed of the frame buffer 123 is greater than or equal to the total of the bit rate of the display data DD and the bit rate of the audio and video data signal AVD, the timing controller 121 may store the dynamic frame transmitted by the audio and video data signal AVD to the frame buffer 123, and access the previous frame in the frame buffer 123 to output the display data DD continuously. On the other hand, if the reading-writing speed of the frame buffer 123 is less than the total of the bit rate of the display data DD and the bit rate of the audio and video data signal AVD, the timing controller 121 may neglect the dynamic frame transmitted by the audio and video data signal AVD, and access the frame in the frame buffer 123 to output the display data DD continuously.

Figure 7:
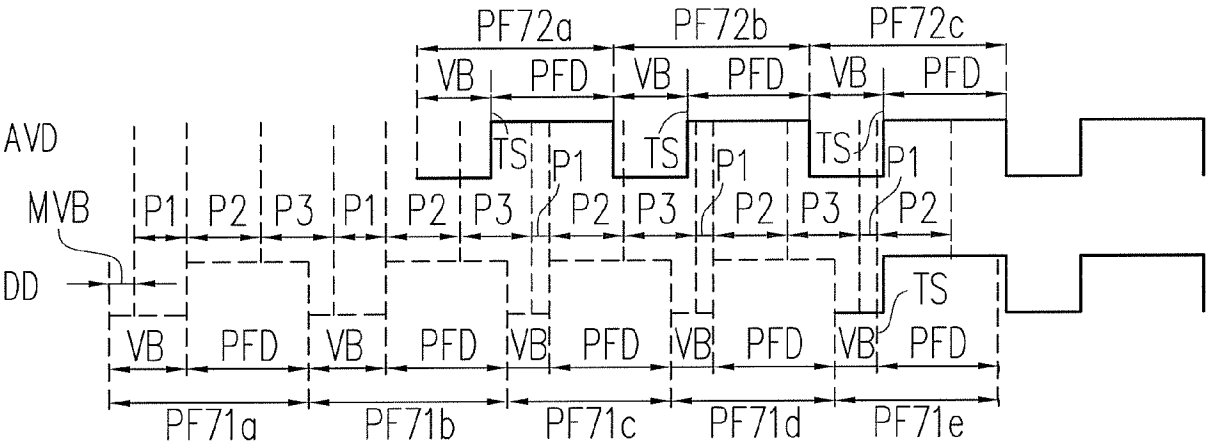
FIG. 7 is a schematic timing diagram of a display system transmitting data according to an embodiment of the invention.

FIG. 7 is a schematic timing diagram of a display system transmitting data according to an embodiment of the invention. Referring to FIG. 1, FIG. 2, FIG. 6 and FIG. 7, in the embodiment, the timing of the display data DD may also be formed a plurality of frame periods (such as PF71*a*~PF71*e*), and the timing of the audio and video data signal AVD may be formed a plurality of frame periods (such as PF72*a*~PF72*c*), wherein the same or like reference numbers are applied to refer to the same or like parts in the drawings and the description.

In the embodiment, the starting time TS of the frame display period PFD in the frame period PF72*a* is located within the third period P3 of the frame period PF71*b* (namely, not located within the first period P1), and thus the timing controller 121 may still access the static frame stored in the frame buffer 123 continuously, and may shorten the vertical blank periods VB of the frame periods PF71*c*~PF71*e*.

After the vertical blank period VB of the frame period PF71*c* is shortened, the starting time TS of the frame display period PFD in the frame period PF72*b* will be located within the third period P3 of the frame period PF71*c* (namely, not located within the first period P1), and thus the timing controller 121 may still access the static frame stored in the frame buffer 123 continuously to output the display data DD. After the vertical blank period VB of the frame period PF71*d* is shortened, the starting time TS of the frame display period PFD in the frame period PF72*c* is not located within the frame period PF71*c* (namely, the starting time TS of the frame display period PFD in the frame period PF72*c* is not located within the first period P1 of the frame period PF71*c*), and thus the timing controller 121 may still access the static frame stored in the frame buffer 123 continuously to output the display data DD.

After the vertical blank period VB of the frame period PF71*e* is shortened, the starting time TS of the frame display period PFD in the frame period PF72*c* will be located within the second period P2 of the frame period PF71*e*. Herein, since the shortened vertical blank period VB leads to a shorter time length of the first period P1, the starting time TS of the frame display period PFD in the frame period (such as PF72*a*~PF72*c*) corresponding to the audio and video data signal AVD may not fall within the first period P1 of one of the frame periods (such as PF71*a*~PF71*e*) corresponding to the display data DD. According to the determination conditions described above, it is possible that the timing controller 121 may not transmit the display data DD corresponding to the dynamic frame transmitted by the audio and video data signal AVD directly to the driving circuit 125, so that errors are generated on the operation of the timing controller 121.

In the embodiment, in order to prevent the errors being generated on the operation of the timing controller 121, whether the starting times TS of the frame display periods PFD in the frame periods (such as PF71*a*~PF71*e*) corresponding to the display data DD fall within the vertical blank periods VB of the frame periods (such as PF72*a*~PF72*c*) corresponding to the audio and video data signal AVD, may be compared. When the starting time TS of the frame display period PFD in the frame period (such as PF71*a*~PF71*e*) corresponding to the display data DD falls within the vertical blank period VB of the frame period (such as PF72*a*~PF72*c*) corresponding to the audio and video data signal AVD, it is indicated that the driving circuit 125 may still have enough time to carry out the pre-process of displaying frames according to the timing of the audio and video data signal AVD. Therefore, the timing controller 121 may transmit the display data DD corresponding to the dynamic frame transmitted by the audio and video data signal AVD directly to the driving circuit 125, such that the driving circuit 125 may drive the display panel 127 according to the received display data DD. As shown in FIG. 7, the dash line indicating the original timing of the display data DD is replaced by the solid line indicating the timing of the audio and video data signal AVD.

In the frame periods PF71*b*~PF71*d*, if the reading-writing speed of the frame buffer 123 is greater than or equal to the total of the bit rate of the display data DD and the bit rate of the audio and video data signal AVD, the timing controller 121 may store the dynamic frame transmitted by the audio and video data signal AVD to the frame buffer 123, and access the previous frame in the frame buffer 123 to output the display data DD continuously. On the other hand, if the reading-writing speed of the frame buffer 123 is less than the total of the bit rate of the display data DD and the bit rate of the audio and video data signal AVD, the timing controller 121 may neglect the dynamic frame transmitted by the audio and video data signal AVD, and access the frame in the frame buffer 123 to output the display data DD continuously.

Figure 8:
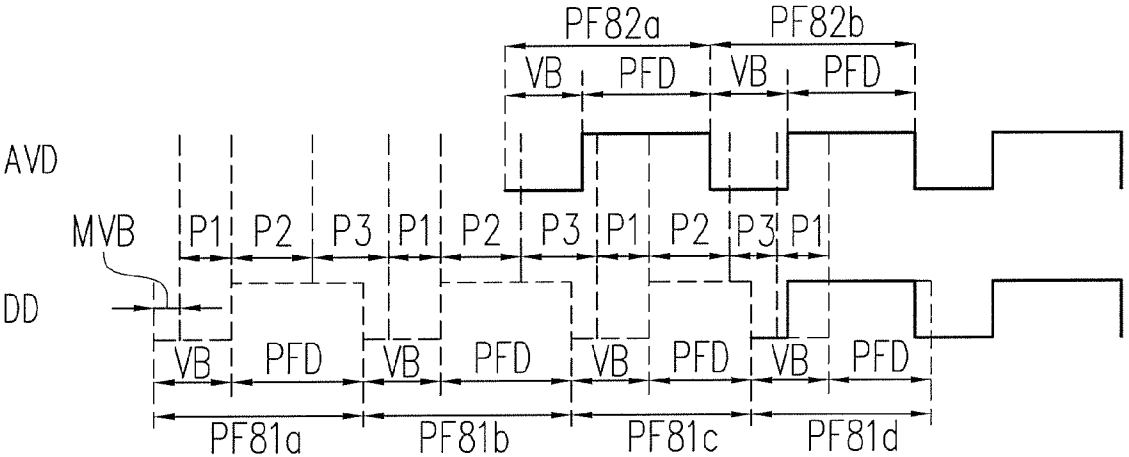
FIG. 8 is a schematic timing diagram of a display system transmitting data according to an embodiment of the invention.

FIG. 8 is a schematic timing diagram of a display system transmitting data according to an embodiment of the invention. Referring to FIG. 1, FIG. 2, FIG. 4, FIG. 6 and FIG. 8, in the embodiment, the timing of the display data DD may also be formed a plurality of frame periods (such as PF81*a*~PF81*d*), and the timing of the audio and video data signal AVD may be formed a plurality of frame periods (such as PF82*a*~PF82*b*), wherein the same or like reference numbers are applied to refer to the same or like parts in the drawings and the description.

In the embodiments of FIG. 6, the starting time TS of the frame display period PFD in the frame period (such as PF62*a*~PF62*c*) corresponding to the audio and video data signal AVD may fall within the first period P1 of one of the frame periods (such as PF61*a*~PF61*e*) corresponding to the display data DD via the shortened vertical blank period VB of the frame period (such as PF61*a*~PF61*e*) corresponding to the display data DD.

In the embodiment, the timing controller 121 may cause the starting time TS of the frame display period PFD in the frame period (such as PF82*a*~PF82*b*) corresponding to the audio and video data signal AVD to fall within the first period P1 of one of the frame periods (such as PF81*a*~PF81*d*) corresponding to the display data DD via the shortened frame display period PFD of the frame period (such as PF81*a*~PF81*d*) corresponding to the display data DD. Wherein, the timing controller 121 may shorten the plurality of horizontal blank periods HB, so as to shorten the frame display period PFD. However, the plurality of horizontal blank periods HB may still be greater than or equal to a minimum time limitation thereof, in order to prevent the driving circuit 125 to drive the display panel 127 incorrectly.

In the embodiment, the starting time TS of the frame display period PFD in the frame period PF82*a* is located within the third period P3 of the frame period PF81*b* (namely, not located within the first period P1), and thus the timing controller 121 may still access the static frame stored in the frame buffer 123 continuously to output the display data DD, and the timing controller 121 may shorten the frame display periods PFD of the frame periods PF81*c* and PF81*d*. After the frame display period PFD of the frame period PF81*c* is shortened, the starting time TS of the frame display period PFD in the frame period PF82*b* is not located within the frame period PF81*c* (namely, the starting time TS of the frame display period PFD in the frame period PF82*b* is not located within the first period P1 of the frame period PF81*c*), and thus the timing controller 121 may still access the static frame stored in the frame buffer 123 continuously to output the display data DD.

After the frame display period PFD of the frame period PF81*d* is shortened, the starting time TS of the frame display period PFD in the frame period PF82*b* is located within the first period P1 of the frame period PF81*d*. Therefore, the timing controller 121 may transmit the display data DD corresponding to the dynamic frame transmitted by the audio and video data signal AVD directly to the driving circuit 125. As shown in FIG. 8, the dash line indicating the original timing of the display data DD is replaced by the solid line indicating the timing of the audio and video data signal AVD.

In the frame periods PF81*b* and PF81*c*, if the reading-writing speed of the frame buffer 123 is greater than or equal to the total of the bit rate of the display data DD and the bit rate of the audio and video data signal AVD, the timing controller 121 may store the dynamic frame transmitted by the audio and video data signal AVD to the frame buffer 123, and access the previous frame in the frame buffer 123 to output the display data DD continuously. On the other hand, if the reading-writing speed of the frame buffer 123 is less than the total of the bit rate of the display data DD and the bit rate of the audio and video data signal AVD, the timing controller 121 may neglect the dynamic frame transmitted by the audio and video data signal AVD, and access the frame in the frame buffer 123 to output the display data DD continuously.

In the embodiments of FIG. 2, FIG. 3, FIG. 5 through FIG. 8 described above, the time length of the second period P2 thereof (that is, the threshold time Tth of the frame display period PFD) may be calculated from the following equation:

$$\frac{Time_{blanking_extended}}{Time_{blanking_extend} + Time_{blanking_shorten}} = \frac{Tth}{Time_{active_region} + Time_{acceptable_minimum_v_blanking}}$$

Wherein, $Time_{blanking_extended}$ may be a time increment of the extended vertical blank period VB in the embodiment of FIG. 3 or a time increment of the extended frame display period PFD in the embodiment of FIG. 5 (that is, the total of time increments of the extended horizontal blank periods HB, with reference to FIG. 4), $Time_{blanking_shorten}$ may be a time reduction of the shortened vertical blank period VB in the embodiment of FIG. 6 or a time reduction of the shortened frame display period PFD in the embodiment of FIG. 8 (that is, the total of time reductions of the shortened horizontal blank periods HB, with reference to FIG. 4), $Time_{active_region}$ is a time length of an active region (that is, the time length of the frame display period PFD), and $Time_{acceptable_minimum_v_blanking}$ is a time length of the minimum tolerance vertical blank period MVB.

Figure 9A:
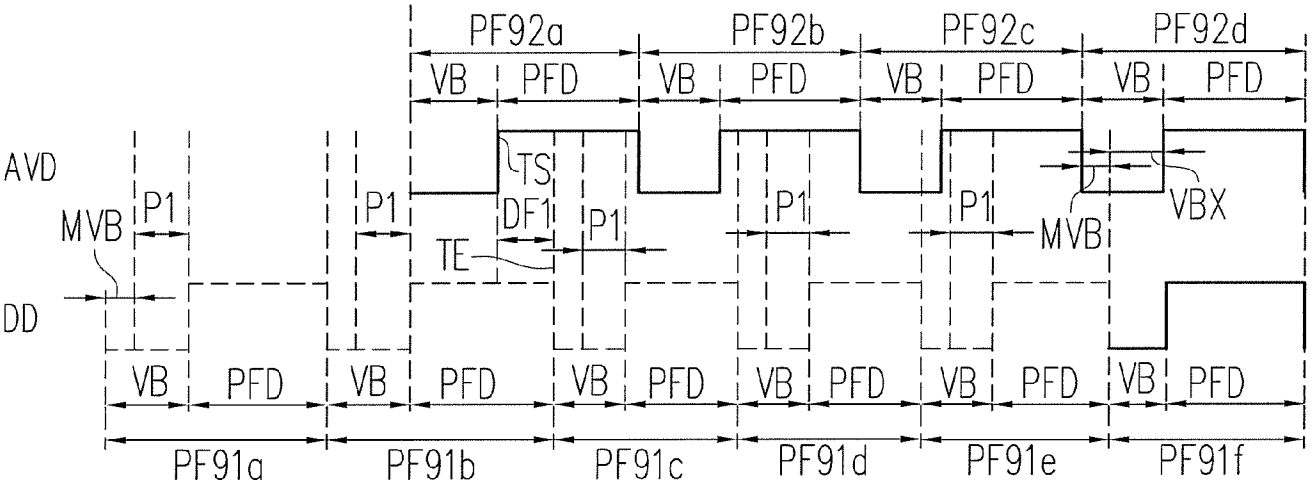
FIG. 9A is a schematic timing diagram of a display system transmitting data according to an embodiment of the invention.

FIG. 9A is a schematic timing diagram of a display system transmitting data according to an embodiment of the invention. Referring to FIG. 1, FIG. 2 and FIG. 9A, in the embodiment, the timing of the display data DD may also be formed a plurality of frame periods (such as PF91*a*~PF91*f*), and the timing of the audio and video data signal AVD may be formed a plurality of frame periods (such as PF92*a*~PF92*d*), wherein the same or like reference numbers are applied to refer to the same or like parts in the drawings and the description.

In the embedment, the starting time TS of the frame display period PFD (corresponding to the first frame display period) in the frame period PF92*a* is located within the frame display period PFD of the frame period PF91*b* (namely, not located within the first period P1). Here, the timing controller 121 may access the frame stored in the frame buffer 123 continuously, calculates a first difference DF1 between the starting time TS of the frame display period PFD in the frame period PF92*a* and the end time TE of the frame display period PFD of the frame period PF91*b* which is closed to and after the starting time TS of the frame display period PFD in the frame period PF92*a*, and may shorten the frame periods PF91*c*~PF91*e*. Wherein, the shortened frame periods PF91*c*~PF91*e* are regulated according to the following equation:

$$Frame_Period_{clk_o_new} \times N + Offset_{clk_o_ori} = Frame_Period_{clk_i} \times N - V_Blanking_{min}$$

Wherein, $Frame_Period_{clk_o_new}$ is the shortened frame period (such as the shortened frame periods PF91*c*~PF91*e*), N is a positive integer and greater than or equal to 1 (herein N is 3 for instance), $Offset_{clk_o_ori}$ is the first difference DF1, $Frame_Period_{clk_i}$ is the frame period corresponding to the audio and video data signal AVD (such as the frame periods PF92*a*~PF92*c*), and $V_Blanking_{min}$ is a period of vertical blank period VB corresponding to the audio and video data signal AVD subtracting from the minimum tolerance vertical blank period MVB corresponding to the audio and video data signal AVD (such as VBX).

After the frame period corresponding to display data (such as the frame periods PF91*c*~PF91*e*) is shortened, the end time TE of the frame display period PFD in the frame period PF91*e* is aligned to the end time of the minimum tolerance vertical blank period MVB of the frame period PF92*d*, so that the timing controller 121 may transmit the display data DD corresponding to the dynamic frame transmitted by the audio and video data signal AVD directly to the driving circuit 125. As shown in FIG. 9A, the dash line indicating the original timing of the display data DD is replaced by the solid line indicating the timing of the audio and video data signal AVD.

In an embodiment of the invention, the timing controller 121 may increase the bit rate of the display data DD to shorten the frame period corresponding to the display data DD (such as the frame periods PF91*c*~PF91*e*). In another embodiment of the invention, the timing controller 121 may shorten the vertical blank period VB or horizontal blank periods HB (with reference to FIG. 4) of the frame period corresponding to the display data DD (such as the frame periods PF91*c*~PF91*e*) to shorten the frame period corresponding to the display data DD (such as the frame periods PF91*c*~PF91*e*).

Figure 9B:
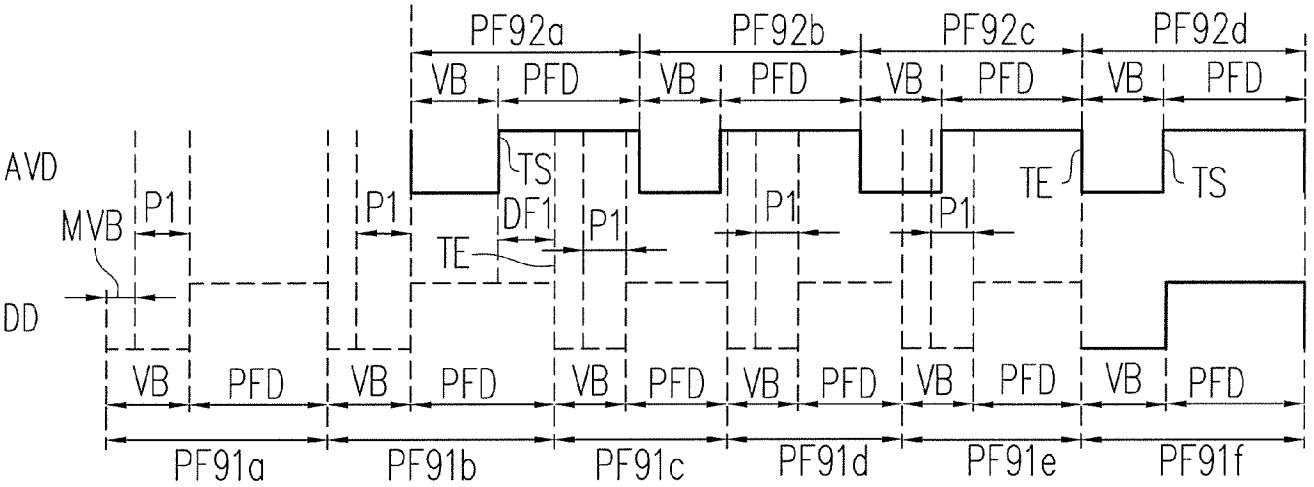
FIG. 9B is a schematic timing diagram of a display system transmitting data according to an embodiment of the invention.

FIG. 9B is a schematic timing diagram of a display system transmitting data according to an embodiment of the invention. Referring to FIG. 9A and FIG. 9B, in the embodiment, the FIG. 9B is similar to the FIG. 9A, the difference therebetween lies in the frame periods PF91*c*~PF91*e*, wherein the same or like reference numbers are applied to refer to the same or like parts in the drawings and the description. In the embodiment, the end time period TE of the frame display period PFD in the frame period PF91*e* is aligned to the end time TE of the frame display period PFD of the frame period PF92*c*. In other word, the shortened frame periods PF91*c*~PF91*e* may be regulated according to the following equation:

$$Frame_Period_{clk_o_new} \times N + Offset_{clk_o_ori} = Frame_Period_{clk_i} \times N - V_Blanking_{clk_i}$$

Wherein, $V_Blanking_{clk_i}$ is the vertical blank period VB of the frame period corresponding to the audio and video data signal AVD (such as the frame periods PF92*a*~PF92*d*). Since the vertical blank period VB is greater than $V_Blanking_{min}$, the end time TE of frame display period PFD of the frame period PF91*e* is far away from the starting time TS of the frame display period PFD in the frame period PF92*d*, so as to avoid the timing of the display data DD can't link with the timing of the audio and video data signal AVD smoothly.

Figure 10:
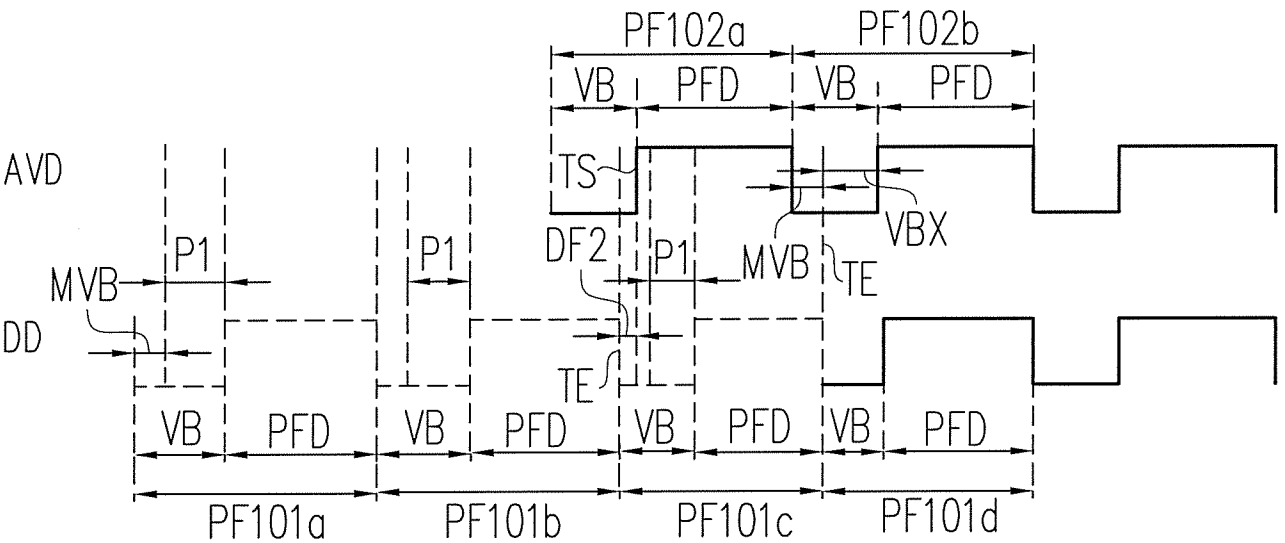
FIG. 10 is a schematic timing diagram of a display system transmitting data according to an embodiment of the invention.

FIG. 10 is a schematic timing diagram of a display system transmitting data according to an embodiment of the invention. Referring to FIG. 1, FIG. 2, FIG. 9A and FIG. 10, in the embodiment, the timing of the display data DD may also be formed a plurality of frame periods (such as PF101*a*~PF101*d*), and the timing of the audio and video data signal AVD may be formed a plurality of frame periods (such as PF102*a*~PF102*b*), wherein the same or like reference numbers are applied to refer to the same or like parts in the drawings and the description.

In the embedment, the starting time TS of the frame display period PFD (corresponding to the first frame display period) in the frame period PF102*a* is located within the minimum tolerance vertical blank period MVB of the frame period PF101*b* (namely, not located within the first period P1). Here, the timing controller 121 may access the frame stored in the frame buffer 123 continuously, calculates a second difference DF2 between the starting time TS of the frame display period PFD in the frame period PF102*a* and the end time TE of the frame display period PFD of the previous frame period PF101*b* which is closed to and before the starting time TS of the frame display period PFD in the frame period PF102*a*, and may shorten the frame periods PF101*c*. Wherein, the shortened frame periods PF101*c* is regulated according to the following equation:

$$\text{Frame_Period}_{clk_o_new} \times N - \text{Offset}_{clk_o_ori} \times \text{Frame_Period}_{clk_o_new} / \text{Frame_Period}_{clk_o_ori} = \text{Frame_Period}_{clk_i} \times N - V_\text{Blanking}_{min}$$

Wherein, $\text{Frame_Period}_{clk_o_new}$ is the shortened frame period (such as the shortened frame period PF101*c*), N is a positive integer and greater than or equal to 1 (herein N is 1 for instance), $\text{Offset}_{clk_o_ori}$ is the second difference DF2, $\text{Frame_Period}_{clk_o_ori}$ is the original frame period corresponding to the display data (such as the frame periods PF101*a*~PF101*b*), $\text{Frame_Period}_{clk_i}$ is the frame period corresponding to the audio and video data signal AVD (such as the frame periods PF102*a*~PF102*b*), and $\text{V_Blanking}_{min}$ is a period of the vertical blank period VB corresponding to the audio and video data signal AVD subtracting from the minimum tolerance vertical blank period MVB corresponding to the audio and video data signal AVD (such as VBX).

After the frame period corresponding to display data (such as the frame period PF101*c*) is shortened, the end time period TE of the frame display period PFD in the frame period PF101*c* is aligned to the end time of the minimum tolerance vertical blank period MVB of the frame period PF102*b*, so that the timing controller 121 may transmit the display data DD corresponding to the dynamic frame transmitted by the audio and video data signal AVD directly to the driving circuit 125. As shown in FIG. 10, the dash line indicating the original timing of the display data DD is replaced by the solid line indicating the timing of the audio and video data signal AVD.

In an embodiment of the invention, the timing controller 121 may increase the bit rate of the display data DD to shorten the frame period corresponding to the display data DD (such as the frame period PF101*c*). In another embodiment of the invention, the timing controller 121 may shorten the vertical blank period VB or horizontal blank periods HB (with reference to FIG. 4) of the frame period corresponding to the display data DD (such as the frame period PF101*c*) to shorten the frame period corresponding to the display data DD (such as the frame periods PF101*c*).

Similar to the FIG. 9B, the end time period TE of the frame display period PFD in the frame period PF101*c* may be aligned to the end time of the frame display period PFD of the frame period PF102*a*. In other word, the shortened frame period PF101*c* may be regulated according to the following equation:

$$\text{Frame_Period}_{clk_o_new} \times N - \mathit{Offset}_{clk_o_ori} \times \text{Frame_Period}_{clk_o_new} / \text{Frame_Period}_{clk_o_ori} = \text{Frame_Period}_{clk_i} \times N - V_\text{Blanking}_{clk_i}$$

Figure 11:
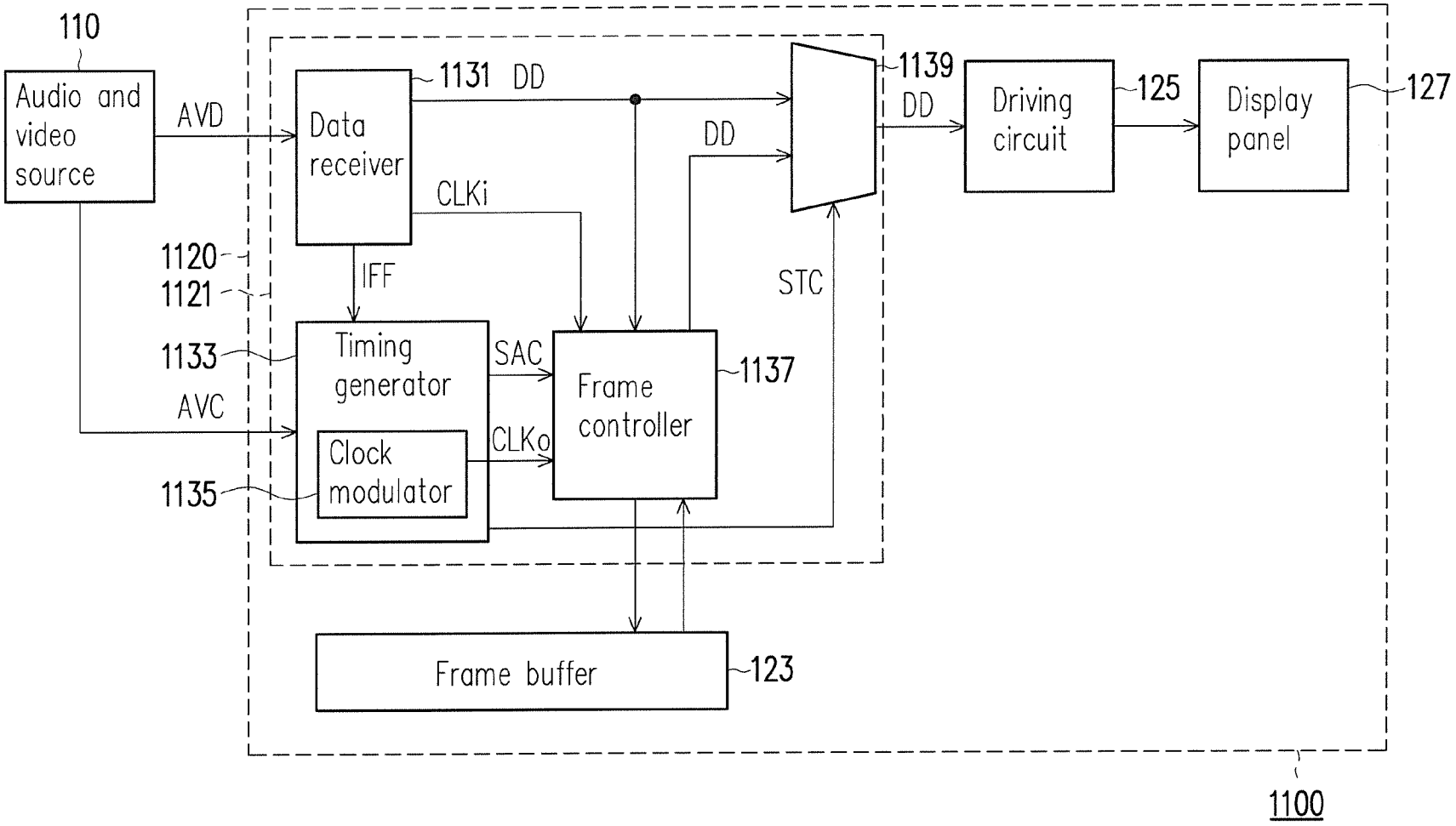
FIG. 11 is a schematic system diagram of a display system according to an embodiment of the invention.

FIG. 11 is a schematic system diagram of a display system according to an embodiment of the invention. Referring to FIG. 1, and FIG. 11, in the embodiment, the display system 1100 is similar to the display system 100, the difference therebetween lies in the timing controller 1121. The timing controller 1121 includes a data receiver 1131, a data multiplexer 1139, a timing generator 1133 and a frame controller 1137.

The data receiver 1131 is coupled to the audio and video source 110 to receive the audio and video data signal AVD, and outputs a frame information IFF corresponding to the audio and video data signal AVD, a first clock signal CLKi corresponding to the audio and video data signal AVD and the display data DD corresponding to the audio and video data signal AVD. Herein, the frame information IFF includes timing information of the audio and video data signal AVD.

The data multiplexer 1139 has a first input terminal, a second input terminal, a first output terminal and a control terminal. The first input terminal of the data multiplexer 1139 is coupled to the data receiver 1131 to receive the display data DD corresponding to the audio and video data signal AVD. The second input terminal of the data multiplexer 1139 is coupled to the frame controller 1137 to receive the display data DD corresponding to the frame storing in the frame buffer 123. The first output terminal of the data multiplexer 1139 is coupled to the driving circuit 125. The control terminal of the data multiplexer 1139 is coupled to the timing generator 110 to receive a state control signal STC. The data multiplexer 1139 couples the first output terminal to the first input terminal or the second output terminal according to the state control signal STC.

The timing generator 1133 is coupled to the data receiver 1131 to receive the frame information IFF corresponding to the audio and video data signal AVD, and calculates other timing information (such as the frame period PF92*a*~PF92*d*, PF102*a*~PF102*b*, the first difference DF1 and the second difference DF2) according to the frame information IFF. The timing generator 1133 having a clock modulator 1135. The timing generator 1133 outputs a access control signal SAC to the frame controller 1137 according to the frame information IFF and the calculated timing information and outputs the state control signal STC according to the audio and video control signal AVC, and the clock modulator 1135 provides a second clock signal CLK_o and regulates the second clock signal CLK_o according the frame information IFF and the calculated timing information.

The frame controller 1137 is coupled to the data receiver 1131, the frame buffer 123, the timing generator 1133 and the second input terminal of the data multiplexer 1139. The frame controller 1137 determining whether to access the frame buffer 123 according to the access control signal SAC, receives the display data DD corresponding to the audio and video data signal AVD according to first clock signal CLK_i, and accesses the frame buffer 123 according to the second clock signal CLK_o.

In the embodiment, the timing generator 1133 may increase the second clock signal CLK_o received by the frame controller through the clock modulator 1135 to increase the bit rate of the display data DD.

Figure 12:
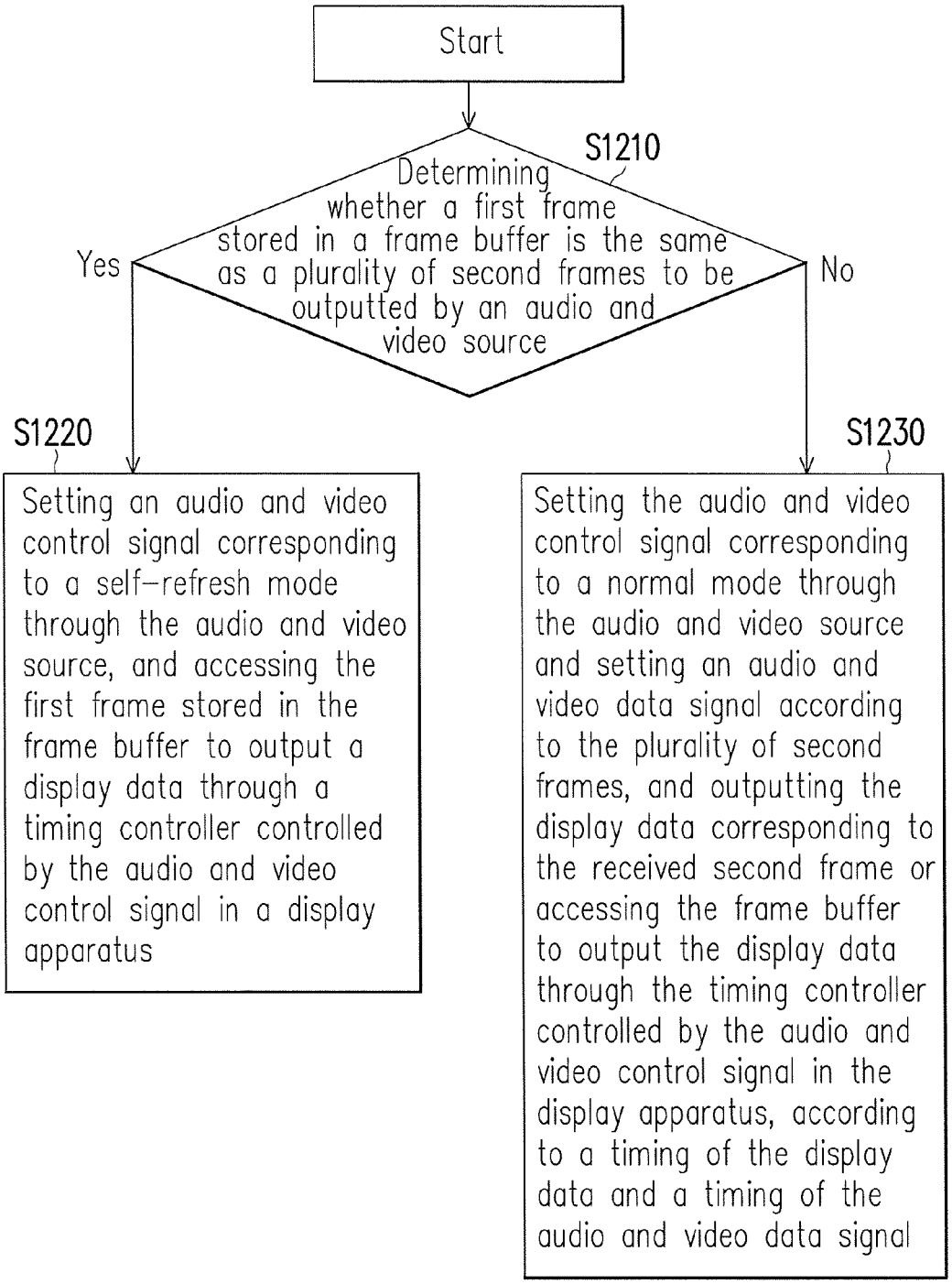
FIG. 12 is a flowchart diagram of a data transmission method of a display system according to an embodiment of the invention.

FIG. 12 is a flowchart diagram of a data transmission method of a display system according to an embodiment of the invention. Referring to FIG. 12, in the embodiment, a first frame stored in a frame buffer is determined whether to be the same as a plurality of second frames to be outputted by an audio and video source (step S1210). When the first frame stored in the frame buffer and the plurality of second frames to be outputted by the audio and video source are the same (namely, the determination result for step S1210 is "Yes"), an audio and video control signal corresponding to a self-refresh mode is set through the audio and video source, and the first frame stored in the frame buffer is accessed through a timing controller controlled by the audio and video control signal in a display apparatus, so as to output a display data (step S1220). Contrarily, when the first frame stored in the frame buffer and the plurality of second frames to be outputted by the audio and video source are different from each other (namely, the determination result for step S1210 is "No"), the audio and video control signal corresponding to a normal mode is set through the audio and video source, and an audio and video data signal is set according to the plurality of second frames, and the display data corresponding to the received second frame is outputted or the frame buffer is accessed to output the display data through the timing controller controlled by the audio and video control signal in the display apparatus, according to a timing of the display data and a timing of the audio and video data signal (step S1230). Wherein, the details of the above steps may be referred to the descriptions for the embodiments of FIG. 1 through FIG. 11, and therefore detailed descriptions thereof are not repeated herein.

To sum up, the display system and the data transmission method thereof are provided in the embodiments of the invention. When the display apparatus is switched from the self-refresh mode to the normal mode, the timing controller determines to output the frame stored in the frame buffer or the second frame transmitted by the audio and video data signal according to the timing of the display data and the timing of audio and video data signal, so as to prevent the display apparatus being displayed abnormal. Moreover, when the timing controller does not output the second frame transmitted by the audio and video data signal directly, the timing controller adjusts the timing of the display data, so that the timing of the display data may link with the timing of the audio and video data signal smoothly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display system, comprising:

an audio and video source, providing an audio and video control signal and an audio and video data signal;

a display apparatus, comprising:

a frame buffer;

a timing controller, coupled to the frame buffer and the audio and video source to receive the audio and video control signal and the audio and video data signal, and to output a display data;

a display panel; and a driving circuit, coupled to the timing controller and the display panel to drive the display panel according to the display data, wherein when a first frame stored in the frame buffer and a plurality of second frames to be outputted by the audio and video source are the same, the audio and video source sets the audio and video control signal corresponding to a self-refresh mode, and the timing controller controlled by the audio and video control signal accesses the first frame stored in the frame buffer to output the display data, and when the first frame stored in the frame buffer and the plurality of second frames to be outputted by the audio and video source are different from each other, the audio and video source sets the audio and video control signal corresponding to a normal mode, and sequentially sets the audio and video data signal according to the plurality of second frames, and the timing controller controlled by the audio and video control signal outputs the display data corresponding to the received second frame or accesses the frame buffer to output the display data, according to timings of the audio and video data signal and the display data, wherein when a starting time of a frame display period corresponding to the audio and video data signal is located within a first period of a frame period corresponding to the display data, the timing controller directly outputs the display data corresponding to the received second frame, wherein when the starting time of the frame display period corresponding to the audio and video data signal is located within a second period and a third period of the frame period corresponding to the display data, the timing controller accesses the frame buffer to output the display data, wherein the first period, the second period and the third period are different from each other, wherein when a reading-writing speed of the frame buffer is greater than or equal to a total of a bit rate of the display data and a bit rate of the audio and video data signal, the timing controller writes the received second frame into the frame buffer, and the timing controller accesses the second frame stored in the frame buffer to output the display data, wherein when the reading-writing speed of the frame buffer is less than the total of the bit rate of the display data and the bit rate of the audio and video data signal, the timing controller neglects the received second frame, and the timing controller accesses the first frame stored in the frame buffer to output the display data.

2. The display system as claimed in claim 1, wherein when the starting time of the frame display period corresponding to the audio and video data signal is located within the second period of the frame period corresponding to the display data, the timing controller extends a plurality of frame periods corresponding to the display data.

3. The display system as claimed in claim 2, wherein the timing controller extends a vertical blank period of each of the frame periods corresponding to the display data.

4. The display system as claimed in claim 2, wherein the timing controller extends a plurality of horizontal blank periods of each of the frame periods corresponding to the display data.

5. The display system as claimed in claim 1, wherein when the starting time of the frame display period corresponding to the audio and video data signal is located within the third period of the frame period corresponding to the display data, the timing controller shortens a plurality of frame periods corresponding to the display data.

6. The display system as claimed in claim 5, wherein the timing controller shortens a vertical blank period of each of the frame periods corresponding to the display data.

7. The display system as claimed in claim 5, wherein the timing controller shortens a plurality of horizontal blank periods of each of the frame periods corresponding to the display data.

8. The display system as claimed in claim 5, wherein when a starting time of a frame display period corresponding to the display data is located in a vertical blank period of a frame period corresponding to the audio and video data signal, the timing controller directly outputs the display data corresponding to the received second frame.

9. The display system as claimed in claim 1, wherein the second period is located within a frame display period of the corresponding frame period and is adjacent to the first period, a time length of the second period equals to a threshold time of the frame display period, and the third period is adjacent to the second period corresponding to the same frame period and the first period corresponding to a next frame period.

10. The display system as claimed in claim 1, wherein the first period is located between a frame display period and a minimum tolerance vertical blank period of the corresponding frame period.

11. The display system as claimed in claim 10, wherein when the starting time of the first frame display period corresponding to the audio and video data signal is located within the minimum tolerance vertical blank period or a frame display period of the frame period corresponding to the display data, the timing controller accesses the frame buffer to output the display data and shortens a plurality of frame periods corresponding to the display data.

12. The display system as claimed in claim 11, wherein the timing controller increases the bit rate of the display data.

13. The display system as claimed in claim 12, wherein the timing controller comprises:

a data receiver, coupled to the audio and video source to receive the audio and video data signal, and outputs a frame information corresponding to the audio and video data signal, a first clock signal corresponding to the audio and video data signal and the display data corresponding to the audio and video data signal;

a data multiplexer, having a first input terminal, a second input terminal and a first output terminal, the first input terminal is coupled to the data receiver to receive the display data corresponding to the audio and video data signal, wherein the data multiplexer couples the first output terminal to the first input terminal or the second output terminal according to a state control signal;

a timing generator, coupled to the data receiver to receive the frame information corresponding to the audio and video data signal, coupled to the audio and video source to receive the audio and video control signal, and having a clock modulator, wherein the timing generator outputs an access control signal according to the frame information and outputs the state control signal according to the audio and video control signal, and the clock modulator provides a second clock signal and regulates the second clock signal according to the frame information; and a frame controller, coupled to the data receiver, the frame buffer, the timing generator and the second input terminal of the data multiplexer, determining whether to access the frame buffer according to the access control signal, receives the display data corresponding to the audio and video data signal according to first clock signal, and accesses the frame buffer according to the second clock signal.

14. The display system as claimed in claim 11, wherein the timing controller shortens a vertical blank period of each of the frame periods corresponding to the display data.

15. The display system as claimed in claim 11, wherein the timing controller shortens a plurality of horizontal blank periods of each of the frame periods corresponding to the display data.

16. The display system as claimed in claim 11, wherein when the starting time of the first frame display period corresponding to the audio and video data signal is located within the frame display period of the frame period corresponding to the display data, the timing controller calculates a first difference between the starting time of the first frame display period corresponding to the audio and video data signal and an end time of the frame display period of the frame period corresponding to the display data which is closed to and after the starting time, and regulates the frame period corresponding to the display data according to the following equation:

$$\text{Frame_Period}_{clk_o_new} \times N + \text{Offset}_{clk_o_ori} = \text{Frame_Period}_{clk_i} \times N - V_\text{Blanking}_{min}$$

wherein, $\text{Frame_Period}_{clk_o_new}$ is the shortened frame period corresponding to the display data, N is a positive integer and greater than or equal to 1, $\text{Offset}_{clk_o_ori}$ is the first difference, $\text{Frame_Period}_{clk_i}$ frame is the ame period corresponding to the audio and video data signal, and $V_\text{Blanking}_{min}$ is a period of a vertical blank period corresponding to the audio and video data signal subtracting from a minimum tolerance vertical blank period corresponding to the audio and video data signal.

17. The display system as claimed in claim 11, wherein when the starting time of the frame display period corresponding to the audio and video data signal is located within the minimum tolerance vertical blank period of the frame period corresponding to the display data, the timing controller calculates a second difference between the starting time of the first frame display period corresponding to the audio and video data signal and an end time of the frame display period of a previous frame period corresponding to the display data which is closed to and before the starting time, and regulates the frame period corresponding to the display data according to the following equation:

$$\text{Frame_Period}_{clk_o_new} \times N - \text{Offset}_{clk_o_ori} \times \text{Frame_Period}_{clk_o_new} / \text{Frame_Period}_{clk_o_ori} = \text{Frame_Period}_{clk_i} \times N - V_\text{Blanking}_{min}$$

wherein, $\text{Frame_Period}_{clk_o_new}$ is the shortened frame period corresponding to the display data, N is a positive integer and greater than or equal to 1, $\text{Offset}_{clk_o_ori}$ is the second difference, $\text{Frame_Period}_{clk_o_ori}$ is the original frame period corresponding to the display data, $\text{Frame_Period}_{clk_i}$ is the frame period corresponding to the audio and video data signal, and $V_\text{Blanking}_{min}$ is a period of a vertical blank period corresponding to the audio and video data signal subtracting from a minimum tolerance vertical blank period corresponding to the audio and video data signal.

18. A data transmission method of a display system, comprising:

when a first frame stored in a frame buffer and a plurality of second frames to be outputted by an audio and video source are the same, setting an audio and video control signal corresponding to a self-refresh mode through the audio and video source, and accessing the first frame stored in the frame buffer through a timing controller controlled by the audio and video control signal in a display apparatus so as to output a display data; and when the first frame stored in the frame buffer and the plurality of second frames to be outputted by the audio and video source are different from each other, setting the audio and video control signal corresponding to a normal mode through the audio and video source, and sequentially setting an audio and video data signal according to the plurality of second frames, and outputting the display data corresponding to the received second frame or accessing the frame buffer to output the display data through the timing controller controlled by the audio and video control signal, according to timings of the audio and video data signal and the display data, wherein the step of outputting the display data corresponding to the received second frame or accessing the frame buffer to output the display data through the timing controller controlled by the audio and video control signal according to the timings of the audio and video data signal and the display data comprises:

when a starting time of a frame display period corresponding to the audio and video data signal is located in a first period of a frame period corresponding to the display data, directly outputting the display data corresponding to the received second frame through the timing controller;

when the starting time of the frame display period corresponding to the audio and video data signal is located in a second period and a third period of the frame period corresponding to the display data, accessing the frame buffer to output the display data through the timing controller, wherein the first period, the second period and the third period are different from each other;

when the starting time of the frame display period corresponding to the audio and video data signal is located in the third period of the frame period corresponding to the display data, shortening the plurality of frame periods corresponding to the display data through the timing controller;

when a reading-writing speed of the frame buffer is greater than or equal to a total of a bit rate of the display data and a bit rate of the audio and video data signal, writing the received second frame to the frame buffer through the timing controller, and accessing the second frame stored in the frame buffer to output the display data through the timing controller; and when the reading-writing speed of the frame buffer is less than the total of the bit rate of the display data and the bit rate of the audio and video data signal, neglecting the received second frame through the timing controller, and accessing the first frame stored in the frame buffer to output the display data through the timing controller.

19. The data transmission method of the display system as claimed in claim 18, further comprising:

when the starting time of the frame display period corresponding to the audio and video data signal is located in the second period of the frame period corresponding to the display data, extending a plurality of frame periods corresponding to the display data through the timing controller.

20. The data transmission method of the display system as claimed in claim 19, wherein the step of extending the plurality of frame periods corresponding to the display data through the timing controller comprises:

extending a vertical blank period of each of the frame periods corresponding to the display data through the timing controller.

21. The data transmission method of the display system as claimed in claim 19, wherein the step of extending the plurality of frame periods corresponding to the display data through the timing controller comprises:

extending a plurality of horizontal blank periods of each of the frame periods corresponding to the display data through the timing controller.

22. The data transmission method of the display system as claimed in claim 18, the step of shortening the plurality of frame periods corresponding to the display data through the timing controller comprises:

shortening a vertical blank period of each of the frame periods corresponding to the display data through the timing controller.

23. The data transmission method of the display system as claimed in claim 18, the step of shortening the plurality of frame periods corresponding to the display data through the timing controller comprises:

shortening a plurality of horizontal blank periods of each of the frame periods corresponding to the display data through the timing controller.

24. The data transmission method of the display system as claimed in claim 18, further comprising:

when a starting time of a frame display period corresponding to the display data is located in a vertical blank period of a frame period corresponding to the audio and video data signal, directly outputting the display data corresponding to the received second frame through the timing controller.

25. The data transmission method of the display system as claimed in claim 18, wherein the second period is located within a frame display period of the corresponding frame period and is adjacent to the first period, a time length of the second period equals to a threshold time of the frame display period, and the third period is adjacent to the second period corresponding to the same frame period and the first period corresponding to a next frame period.

26. The data transmission method of the display system as claimed in claim 18, wherein the first period is located between a frame display period and a minimum tolerance vertical blank period of the corresponding frame period.

27. The data transmission method of the display system as claimed in claim 26, wherein the step of outputting the display data corresponding to the received second frame or accessing the frame buffer to output the display data through the timing controller controlled by the audio and video control signal according to the timings of the audio and video data signal and the display data further comprises:

when the starting time of the first frame display period corresponding to the audio and video data signal is located within the minimum tolerance vertical blank period or a frame display period of the frame period corresponding to the display data, accessing the frame buffer to output the display data and shortening a plurality of frame periods corresponding to the display data.

28. The data transmission method of the display system as claimed in claim 27, wherein shortening a plurality of frame periods corresponding to the display data further comprises:

increasing the bit rate of the display data.

29. The data transmission method of the display system as claimed in claim 27, wherein shortening a plurality of frame periods corresponding to the display data further comprises:

shortening a vertical blank period of each of the frame periods corresponding to the display data.

30. The data transmission method of the display system as claimed in claim 27, wherein shortening a plurality of frame periods corresponding to the display data further comprises:

shortening a plurality of horizontal blank periods of each of the frame periods corresponding to the display data.

31. The data transmission method of the display system as claimed in claim 27, wherein shortening a plurality of frame periods corresponding to the display data further comprises:

when the starting time of the first frame display period corresponding to the audio and video data signal is located within the frame display period of the frame period corresponding to the display data, calculating a first difference between the starting time of the frame display period corresponding to the audio and video data signal and an end time of the frame display period of the frame period corresponding to the display data which is closed to and after the starting time, and regulates the frame period corresponding to the display data according to the following equation:

$$\text{Frame_Period}_{clk_o_new} \times N + \text{Offset}_{clk_o_ori} = \text{Frame_Period}_{clk_i} \times N - V_\text{Blanking}_{min}$$

wherein, $\text{Frame_Period}_{clk_o_new}$ is the shortened frame period corresponding to the display data, N is a positive integer and greater than or equal to 1, $\text{Offset}_{clk_o_ori}$ is the first difference, $\text{Frame_Period}_{clk_i}$ is the frame period corresponding to the audio and video data signal, and $V_\text{Blanking}_{min}$ is a period of a vertical blank period corresponding to the audio and video data signal subtracting from a minimum tolerance vertical blank period corresponding to the audio and video data signal.

32. The data transmission method of the display system as claimed in claim 27, wherein shortening a plurality of frame periods corresponding to the display data further comprises:

when the starting time of the first frame display period corresponding to the audio and video data signal is located within the minimum tolerance vertical blank period of the frame period corresponding to the display data, calculating a second difference between the starting time of the frame display period corresponding to the audio and video data signal and an end time of the frame display period of a previous frame period corresponding to the display data which is closed to and before the starting time, and regulates the frame period corresponding to the display data according to the following equation:

$$\text{Frame_Period}_{clk_o_new} \times N - \text{Offset}_{clk_o_ori} \times \text{Frame_Period}_{clk_o_new} / \text{Frame_Period}_{clk_o_ori} = \text{Frame_Period}_{clk_i} \times N - V\text{_Blanking}_{min}$$

wherein, $\text{Frame_Period}_{clk_o_new}$ is the shortened frame period corresponding to the display data, N is a positive integer and greater than or equal to 1, $\text{Offset}_{clk_o_ori}$ is the second difference, $\text{Frame_Period}_{clk_o_ori}$ is the original frame period corresponding to the display data, $\text{Frame_Period}_{clk_i}$ is the frame period corresponding to the audio and video data signal, and $\text{V_Blanking}_{min}$ is a period of a vertical blank period corresponding to the audio and video data signal subtracting from a minimum tolerance vertical blank period corresponding to the audio and video data signal.

* * * * *